US009782000B2

(12) United States Patent
Kahle et al.

(10) Patent No.: US 9,782,000 B2
(45) Date of Patent: Oct. 10, 2017

(54) ADJUSTABLE RACK

(71) Applicants: James Kahle, Marengo, IA (US); Mary Kahle, Marengo, IA (US)

(72) Inventors: James Kahle, Marengo, IA (US); Mary Kahle, Marengo, IA (US)

( * ) Notice: Subject to any disclaimer, the term of this patent is extended or adjusted under 35 U.S.C. 154(b) by 0 days.

(21) Appl. No.: 15/161,453

(22) Filed: May 23, 2016

(65) Prior Publication Data

US 2016/0338489 A1 Nov. 24, 2016

Related U.S. Application Data

(60) Provisional application No. 62/165,382, filed on May 22, 2015.

(51) Int. Cl.

| | |
|---|---|
| ***A47F 5/08*** | (2006.01) |
| ***A47B 81/00*** | (2006.01) |
| ***A47B 96/06*** | (2006.01) |
| ***A47B 96/14*** | (2006.01) |
| *A47F 5/10* | (2006.01) |
| *A47F 5/00* | (2006.01) |

(52) U.S. Cl.

CPC ..... *A47B 81/005* (2013.01); *A47B 96/06* (2013.01); *A47B 96/1466* (2013.01); *A47F 5/00* (2013.01); *A47F 5/0846* (2013.01); *A47F 5/103* (2013.01)

(58) Field of Classification Search

CPC ... A47B 81/005; A47B 96/06; A47B 96/1466; F41A 23/26; A47F 5/00; A47F 5/0846; A47F 5/03

USPC ..... 211/64, 87.01, 90.02, 94.01, 94.02, 103, 211/106.01, 86.01, 162; 248/220.21, 248/220.42, 220.41, 220.43, 235, 248/241–243; 206/317, 315.11; 89/37.04

See application file for complete search history.

(56) References Cited

U.S. PATENT DOCUMENTS

| | | | | | |
|---|---|---|---|---|---|
| 568,039 | A * | 9/1896 | Pollard | A47B 57/42 | 248/243 |
| 707,192 | A * | 8/1902 | Aiken | A47G 25/746 | 211/120 |
| 887,272 | A * | 5/1908 | Robinson | F16L 3/2235 | 211/60.1 |
| 945,520 | A * | 1/1910 | Grennwood | F41A 23/18 | 211/64 |
| 1,632,036 | A * | 6/1927 | Mullen | E04D 13/0722 | 223/50 |
| 2,285,632 | A * | 6/1942 | Urbain | A47F 7/0035 | 211/60.1 |
| 2,400,322 | A * | 5/1946 | Wheeler | F41A 27/10 | 89/134 |
| 2,634,865 | A * | 4/1953 | Geheb | A47J 47/16 | 211/41.11 |
| 2,788,902 | A * | 4/1957 | Nowicki | A47B 96/028 | 108/106 |
| 2,823,808 | A * | 2/1958 | Hindi | B60R 7/14 | 211/64 |
| 2,928,512 | A * | 3/1960 | Slater | A47B 57/565 | 248/243 |
| 2,946,452 | A * | 7/1960 | Caloiero | A47B 81/005 | 211/4 |

(Continued)

*Primary Examiner* — Joshua J Michener
*Assistant Examiner* — Devin Barnett
(74) *Attorney, Agent, or Firm* — David M. Breiner; BrownWinick Law Firm

(57) ABSTRACT

Disclosed is an adjustable rack. In example embodiments, the rack may include a rail enclosing a nut used to fix a holder to the rail.

11 Claims, 20 Drawing Sheets

(56) References Cited

U.S. PATENT DOCUMENTS 3,291,317 A * 12/1966 Bowen ..... F41A 23/18 211/4
3,294,247 A * 12/1966 Norrington ..... A47B 81/005 211/64
3,326,385 A * 6/1967 Pinkerton ..... B60R 7/14 211/4
3,329,278 A * 7/1967 Pachmayr ..... F41A 23/18 206/317
3,731,817 A * 5/1973 Fowlkes ..... A01K 97/08 211/70.8
3,826,207 A * 7/1974 Sutherlan ..... A47B 57/487 108/101
3,857,491 A * 12/1974 Townsend ..... A47B 81/005 211/64
3,931,893 A * 1/1976 Elkins ..... A47B 81/005 211/64
4,058,221 A * 11/1977 Elkins ..... B60R 7/14 211/106.01
4,108,313 A * 8/1978 Bogar, Jr. ..... A47B 81/005 211/106.01
4,139,100 A * 2/1979 Reed ..... F41A 17/02 211/4
4,170,801 A * 10/1979 Ward ..... A01K 97/08 114/343
4,212,445 A * 7/1980 Hagen ..... F16B 12/34 248/222.52
4,291,928 A * 9/1981 Kiyosawa ..... A47B 96/1416 108/107
4,375,268 A * 3/1983 Speck ..... B60R 7/12 211/62
4,450,989 A * 5/1984 Bogar, Jr. ..... A47B 81/005 211/64
4,596,334 A * 6/1986 Daulton ..... A47B 81/005 211/4
4,624,372 A * 11/1986 Brolin ..... A47B 81/005 211/4
4,648,516 A * 3/1987 Elkins ..... A47B 81/005 211/64
4,776,471 A * 10/1988 Elkins ..... A47B 81/005 211/64
D310,446 S * 9/1990 Elkins ..... 211/64
4,991,723 A * 2/1991 Elkins ..... A47B 81/005 211/106.01
5,058,302 A * 10/1991 Minneman ..... F41A 23/18 206/315.11
5,145,135 A * 9/1992 Thompson ..... A47F 5/0876 211/60.1
5,154,385 A * 10/1992 Lindberg ..... A47B 57/562 248/225.11
5,249,722 A * 10/1993 Horn ..... B60R 7/14 211/64
5,339,966 A * 8/1994 Bastiaans ..... A47B 81/005 211/4
5,344,032 A * 9/1994 Ramsdell ..... A47B 81/005 211/64
5,503,276 A * 4/1996 Pierce ..... F41A 23/18 211/59.1
5,524,772 A * 6/1996 Simmons ..... A47B 81/005 211/4
5,645,177 A * 7/1997 Lin ..... B25H 3/04 206/378
5,676,257 A * 10/1997 Adkins ..... A47B 81/005 211/4
5,695,078 A * 12/1997 Otema ..... A47B 57/045 108/108
5,833,079 A * 11/1998 Roberts ..... A47B 81/00 211/105.1
6,086,300 A * 7/2000 Frohlich ..... F16B 37/045 411/107
6,105,794 A * 8/2000 Bauer ..... A47B 57/26 108/108
6,168,018 B1 * 1/2001 Ramsey ..... B25H 3/06 206/378
6,305,117 B1 * 10/2001 Hales, Sr. ..... F41A 23/02 42/94
6,338,218 B1 * 1/2002 Hegler ..... F41A 23/02 42/94
6,390,309 B1 * 5/2002 Tucker ..... A47B 81/00 211/103
6,409,029 B1 * 6/2002 Bermes ..... A01D 75/004 211/207
6,450,378 B1 * 9/2002 Miller ..... B60R 7/14 211/64
6,591,996 B1 * 7/2003 Wu ..... A47B 57/26 211/103
6,742,687 B2 * 6/2004 Morford ..... B60R 7/14 211/64
6,827,320 B2 * 12/2004 Yeh ..... A47B 57/565 248/220.22
6,829,857 B1 * 12/2004 Houtsma ..... F41A 23/10 248/532
6,843,081 B1 * 1/2005 Painter ..... F41C 33/06 109/45
6,913,286 B2 * 7/2005 Kramer ..... B60R 7/14 211/64
6,929,223 B2 * 8/2005 Hancock ..... B60R 11/00 211/64
7,730,824 B1 * 6/2010 Black ..... F41A 23/16 42/94
7,798,339 B2 * 9/2010 Brooks ..... G11B 33/02 211/103
7,832,570 B1 * 11/2010 Reynolds ..... A47B 57/56 211/103
8,006,424 B1 * 8/2011 Ligard ..... F41A 17/02 211/64
8,016,137 B2 * 9/2011 Shaha ..... A47B 96/061 211/103
8,038,112 B2 * 10/2011 Kluge ..... A47B 96/1466 248/235
8,297,565 B2 * 10/2012 McLinda ..... A01K 97/10 248/157
8,444,034 B2 * 5/2013 Bennett ..... B60R 7/14 211/64
8,544,202 B2 * 10/2013 Bastian, Jr. ..... F41A 23/18 42/94
8,590,440 B2 * 11/2013 Gallo ..... A45B 3/00 135/66
8,636,154 B2 * 1/2014 Chinn ..... A61G 3/0841 211/101
8,651,300 B2 * 2/2014 Chen ..... A47B 47/024 108/107
8,727,294 B1 * 5/2014 Harms ..... F41A 23/18 206/317
8,739,982 B2 * 6/2014 Werner ..... F41C 33/06 206/317
8,757,399 B2 * 6/2014 Wolfbauer ..... A01K 97/08 211/60.1
8,973,316 B2 * 3/2015 Safford ..... E04B 2/885 52/204.62
2004/0262473 A1 * 12/2004 Tomonari ..... A47B 57/34 248/243
2005/0006539 A1 * 1/2005 Fischer ..... A47F 5/0846 248/220.42
2006/0201898 A1 * 9/2006 Hughes ..... B60R 7/14 211/64
2006/0248775 A1 * 11/2006 Wade ..... F41A 23/34 42/94
2007/0241010 A1 * 10/2007 Giebel ..... A47B 81/00 206/317
2008/0048081 A1 * 2/2008 Costa ..... A47B 57/00 248/241
2009/0205238 A1 * 8/2009 Willis, Jr. ..... F41A 27/28 42/94
2011/0132853 A1 * 6/2011 Drobot ..... A47B 57/562 211/42
2011/0197748 A1 * 8/2011 Roberts ..... F41A 25/04 89/37.04

(56) References Cited

U.S. PATENT DOCUMENTS

| | | | | |
|---|---|---|---|---|
| 2012/0037579 | A1* | 2/2012 | Muldoon | A01K 97/08 211/64 |
| 2012/0085721 | A1* | 4/2012 | Drobot | A47B 57/562 211/103 |
| 2012/0261368 | A1* | 10/2012 | Klein | A47B 81/005 211/64 |
| 2012/0267282 | A1* | 10/2012 | Holmes, Jr. | E05G 1/06 206/526 |
| 2015/0027972 | A1* | 1/2015 | Andersson | A47B 57/42 211/94.01 |
| 2015/0129730 | A1* | 5/2015 | Gold | A47F 5/0823 248/220.42 |
| 2015/0150389 | A1* | 6/2015 | Nilsson | B25H 3/04 248/220.42 |
| 2015/0182020 | A1* | 7/2015 | Rahman | B60R 7/14 211/64 |

* cited by examiner

ADJUSTABLE RACK

CROSS REFERENCE TO RELATED APPLICATIONS

This application claims the benefit of U.S. Patent Application No. 62/165,382 filed with the United States Patent and Trademark Office on May 22, 2015, the entire contents of which are hereby incorporated by reference.

BACKGROUND

1. Field

Example embodiments relate to an adjustable rack. In example embodiments, the rack may include a rail enclosing a connector used to fix a holder to the rail. In example embodiments the rack may have several uses, for example, supporting one or more guns.

2. Description of the Related Art

FIG. 1 is a view of gun rack 10 disclosed in U.S. Pat. No. 2,946,452. As shown in FIG. 1, the gun rack 10 includes cradles 5 for holding guns. Gun rack designs like the one shown in FIG. 1 are common in the market place. Such rack are easy to build and use.

SUMMARY

The inventors have noted that conventional gun racks, like that shown in FIG. 1, suffer several drawbacks. For example, they are typically prefabricated with a predetermined number of cradles for storing a predetermined number of guns. Thus, adding more cradles to an existing gun rack is generally not possible. As yet another example, the positions of the cradles are typically fixed and do not allow for an adjustability of height. In view of these problems the inventors set out to design a new gun rack with an eye towards curing the above problems. As a result, the inventors developed a new and nonobvious gun rack capable of adding or taking away cradles and for adjusting a position of the cradles. The invention, however, is not limited to merely racks used to store guns but may be used to store other types of items such as bars and/or pipes.

In example embodiments a rack may include at least one rail, a connector, a holder (an example of a cradle), and a fastener. In example embodiments, the at least one rail may have a channel with an upper most portion defining a receiving area, the connector may be in the channel, the holder may be in the receiving area, and the fastener may connect the holder to the first connector.

BRIEF DESCRIPTION OF THE DRAWINGS

Example embodiments are described in detail below with reference to the attached drawing figures, wherein.

DETAILED DESCRIPTION

Figure 1:
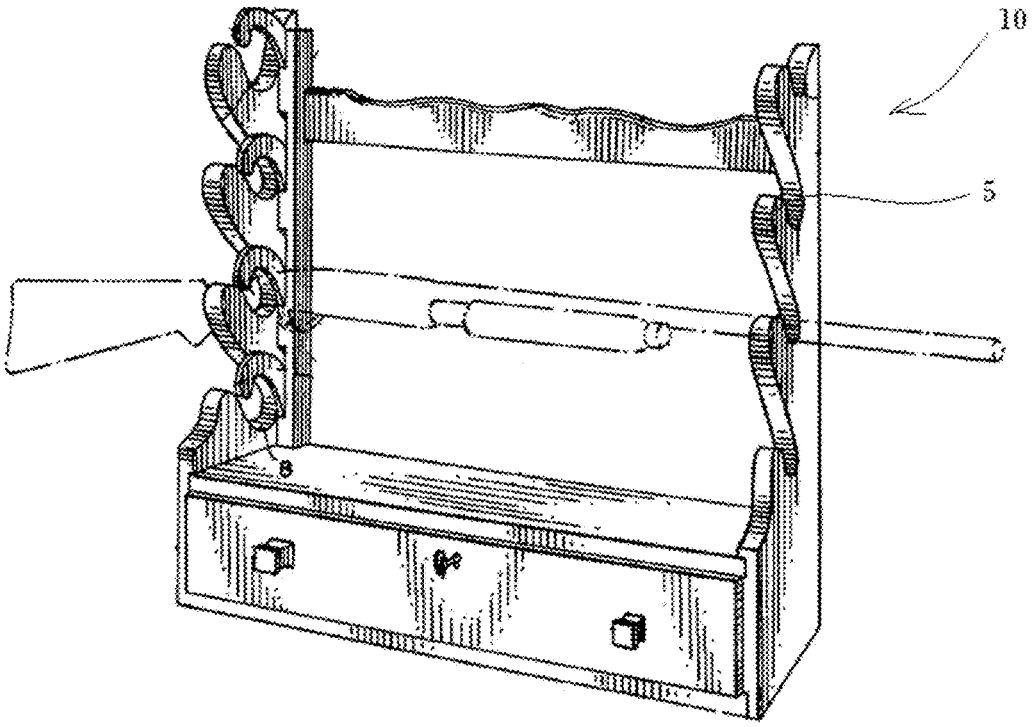
FIG. 1 PRIOR ART
FIG. 1 is a perspective view of a gun rack in accordance with the prior art.

Example embodiments will now be described more fully with reference to the accompanying drawings, in which example embodiments of the invention are shown. The invention may, however, be embodied in different forms and should not be construed as limited to the example embodiments set forth herein. Rather, these example embodiments are provided so that this disclosure will be thorough and complete, and will fully convey the scope of the invention to those skilled in the art. In the drawings, the sizes of components may be exaggerated for clarity.

In this application, it is understood that when an element or layer is referred to as being "on," "attached to," "connected to," or "coupled to" another element or layer, it can be directly on, directly attached to, directly connected to, or directly coupled to the other element or layer or intervening elements that may be present. In contrast, when an element is referred to as being "directly on," "directly attached to," "directly connected to," or "directly coupled to" another element, there are no intervening elements present. As used herein, the term "and/or" includes any and all combinations of one or more of the associated listed items.

In this application it is understood that, although the terms first, second, etc. may be used herein to describe various elements and/or components, these elements and/or components should not be limited by these terms. These terms are only used to distinguish one element, component, region, layer, and/or section from another elements, component, region, layer, and/or section. Thus, a first element, component region, layer or section discussed below could be termed a second element, component, region, layer, or section without departing from the teachings of example embodiments.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the structure in use or operation in addition to the orientation depicted in the figures. For example, if the structure in the figures is turned over, elements described as "below" or "beneath" other elements or features would then be oriented "above" the other elements or features. Thus, the exemplary term "below" can encompass both an orientation of above and below. The structure may be otherwise oriented (rotated 90 degrees or at other orientations) and the spatially relative descriptors used herein interpreted accordingly.

Embodiments described herein will refer to planform views and/or cross-sectional views by way of ideal schematic views. Accordingly, the views may be modified depending on manufacturing technologies and/or tolerances. Therefore, example embodiments are not limited to those shown in the views, but include modifications in configurations formed on the basis of manufacturing process. Therefore, regions exemplified in the figures have schematic properties and shapes of regions shown in the figures exemplify specific shapes or regions of elements, and do not limit example embodiments.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to an adjustable rack. In example embodiments, the rack may include a rail enclosing a connector used to fix a holder to the rail.

Figure 2:
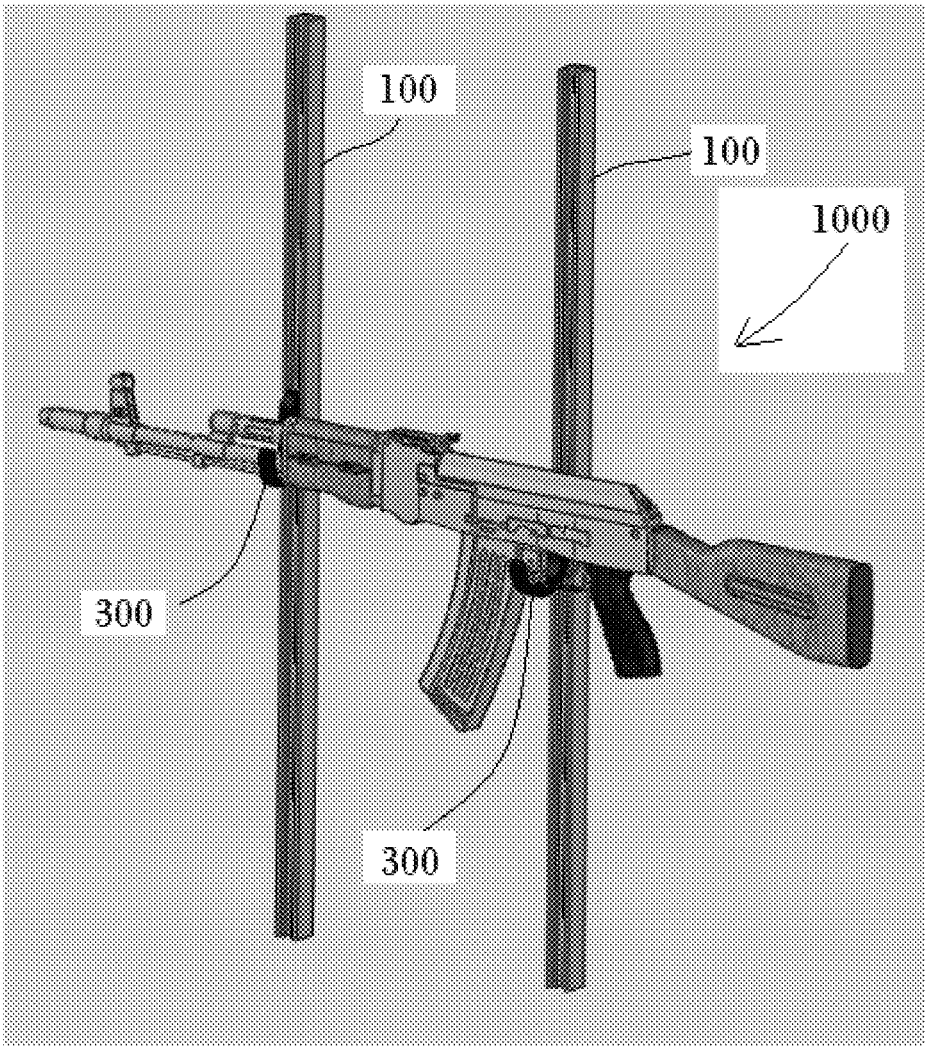
FIG. 2 a perspective view of a gun rack in accordance with example embodiments.

FIG. 2 is a view of a gun rack 1000 supporting a gun in accordance with example embodiments. In FIG. 2, the gun rack 1000 includes a pair of rails 100 and a pair of holders 300 for supporting the gun. Although FIG. 2 illustrates the gun rack 1000 as comprising a pair rails 100 and a pair of holders 300 other embodiments of a gun rack include only a single rail 100 with a single holder 500 (see FIGS. 11 to 12C) or more than two rails 100 and/or more than two holders 300. As such, the example of FIG. 2 is for purposes of illustration only and is not intended to limit the invention.

Figure 3A:
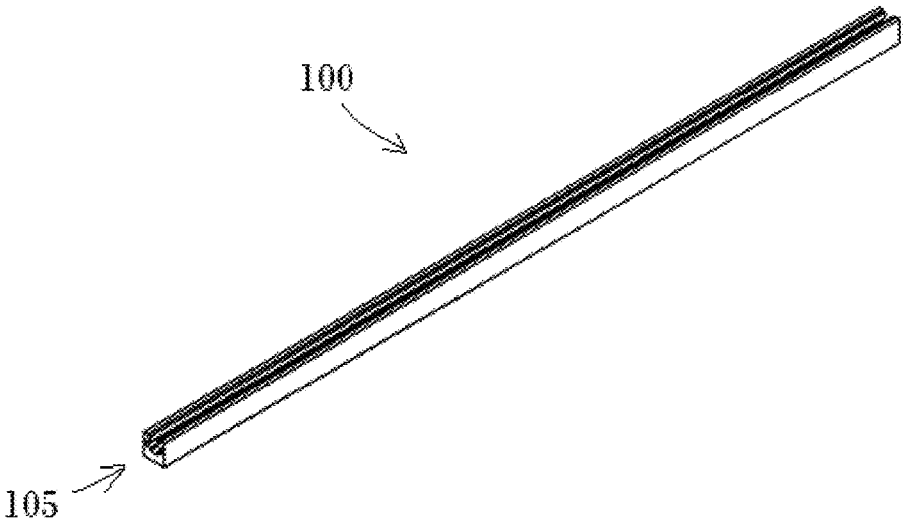
FIGS. 3A-3C are views of a slide rail in accordance with example embodiments.
Figure 3B:
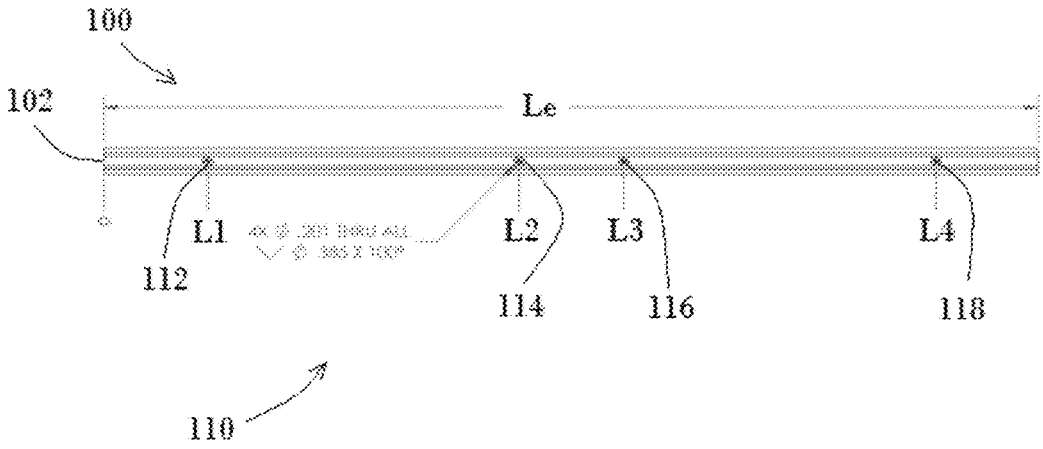
Figure 3C:
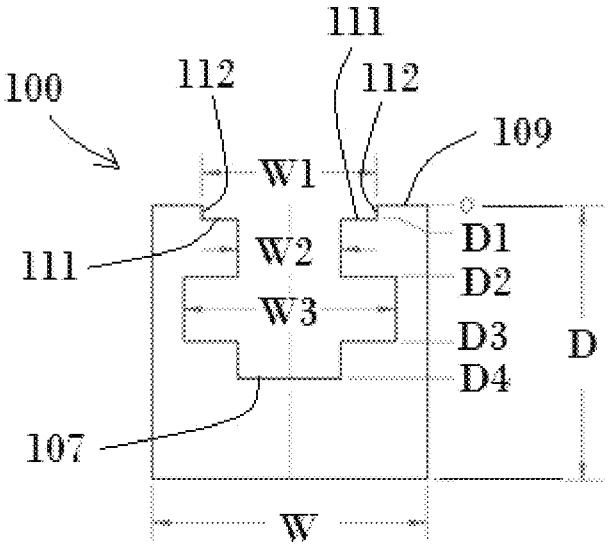

FIGS. 3A-3C are views of a rail 100 in accordance with example embodiments. FIG. 3A, for example, is a perspective view of the rail 100, FIG. 3B is a top view of the rail 100, and FIG. 3C is a cross-section view of the rail 100. As shown in FIGS. 3A-3C, the rail 100 may resemble a relatively long bar with a channel 105 formed therein. For example, the rail 100 may have a length Le of about thirty six inches, a depth D of about one inch, and a width W of about one inch. These dimensions, however, are only for purposes of illustration as the rail 100 may be shorter or longer than thirty six inches, wider or narrower than one inch, and/or deeper or shallower than one inch.

In example embodiments, a cross-section of the channel 105 may have a somewhat irregular and/or stepped shape. For example, as shown in FIG. 3C, a width of the channel 105 may vary from a floor 107 of the channel 105 to a top 109 of the rail 100. For example, the channel 105 may have an overall depth D4 and the width of the channel 105 may change as the depth of the channel 105 changes. For example, in one embodiment, the width of the channel may change at about three different depths relative to the top 109 of the rail 100. For example, at the floor 107 (for example at elevation D4) the channel 105 may have a given width, however, at a depth of D3, which may be smaller than the depth D4, a width of the channel 105 may increase and then decrease again at a depth of D2 which is smaller than the depth D3. The width of the channel 105 may change again (for example, increase) at a depth of D1 which may be smaller than depth D2. For example, in one nonlimiting example embodiment, the channel 105 may have a depth D4 of about six tenths of an inch with respect to the top 109 of the rail 100. This portion of the channel 105 may have a width of about three eighths of an inch and may resemble a rectangular channel. As the depth of the channel 105 decreases, for example to a depth D3, which may be about half an inch with respect to the top 109 of the rail 100, a width of the channel may increase, for example, to a width W3 which may be about three quarters of an inch. This portion of the channel 105 may also resemble a rectangular channel. Again, a width of the channel 105 may decrease as the depth of the channel 105 decreases to D2 which may be about one quarter of an inch from the top 109 of the channel 100. At this point, the width of the channel 105 may decrease to the width W2 which may be about three eighths of an inch. Again, the width of the channel 105 may change at about a depth of D1 from the top 109 of the rail 100 which may be about one twentieth of an inch thereby increasing the channel width to a width W1 which may be, but is not required to be, about six tenths of an inch wide. The instant dimensions, of course, are for purposes of illustration only and are not intended to limit the invention as the dimensions may change without departing from the teachings of example embodiments.

In example embodiments, the floor 107 of the channel 105 may include a plurality of apertures 110 formed therein. For example, in one embodiment, the floor 107 may include four apertures 112, 114, 116, and 118 spaced along a length of the rail 100. The apertures 110, for example, may resemble circular holes which may or may not be threaded. The apertures 110 may be allow screws or another type of connecting device to attach the rail 100 to a wall or some other suitable structure.

In the embodiment illustrated in FIGS. 3A-3C, the first aperture 112 may be spaced a first distance L1 from an end 102 of the rail 100, the second aperture 114 may be spaced a second distance L2 from the end 102 of the rail 100, the third aperture 116 may be spaced a third distance L3 from the end 102 of the rail 100, and the fourth aperture 118 may be spaced a fourth distance L4 from the end 102 of the rail 100. In one nonlimiting example embodiment, the first distance L1 may be, but is not required to be, about four inches, the second distance L2 may be, but is not required to be, about sixteen inches, the third distance L3 may be, but is not required to be, twenty inches, and the fourth distance L4 may be, but is not required to be, about thirty two inches. These dimensions are only included for purposes of illustration only and are not meant to limit example embodiments. Furthermore, although example embodiments illustrate the rail 100 as having four apertures 112, 114, 116, and 118, the rail 100 may actually have more or less than four apertures. For example, apertures 114 and 116 may be omitted. Of course, the apertures may be omitted in their entirety without departing from the teachings of example embodiments.

Figure 4A:
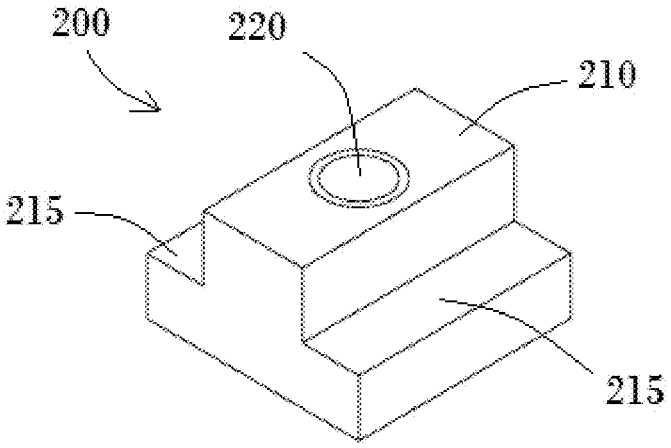
FIGS. 4A-4D are views of a connector in accordance with example embodiments.
Figure 4B:
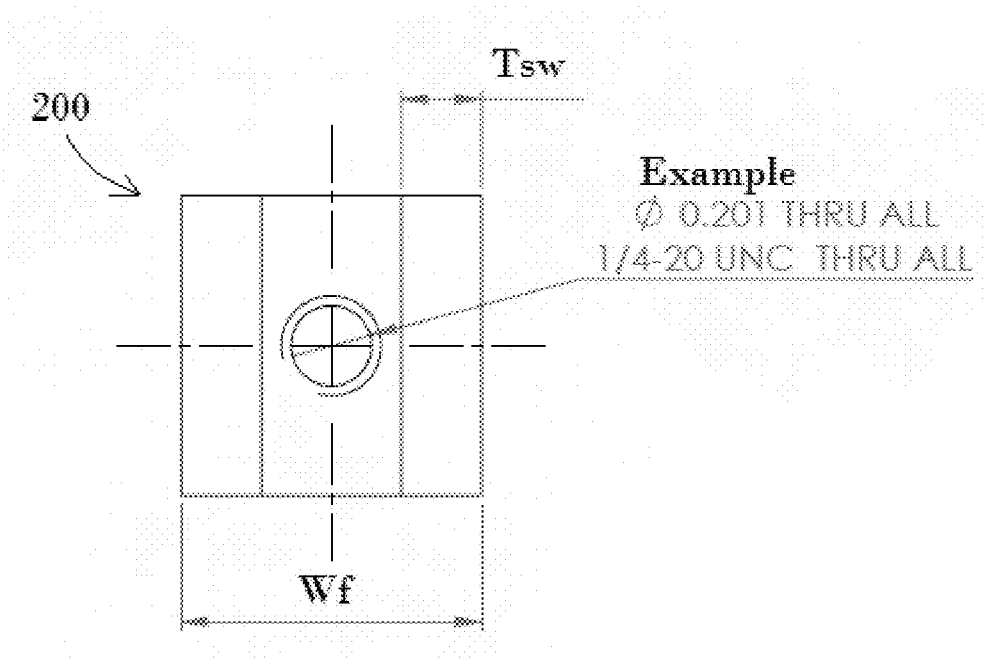
Figure 4C:
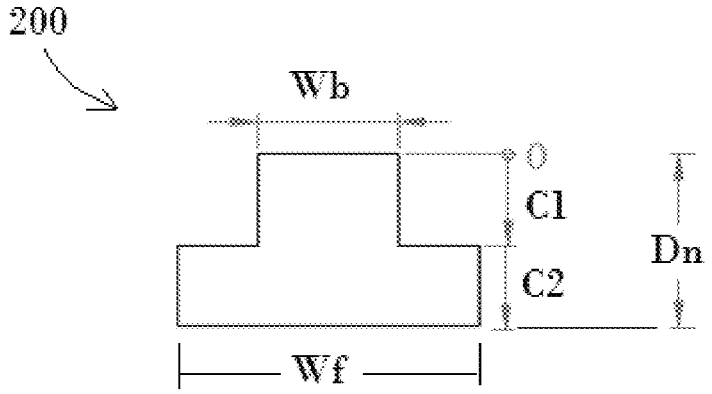
Figure 4D:
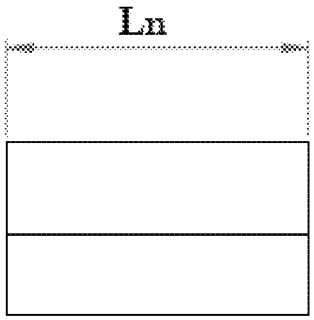

FIGS. 4A-4B are views of a connector 200 in accordance with example embodiments. In example embodiments the connector 200 may include a body 210 with flanges 215 entending therefrom. In example embodiments, the body 210 may further include an aperture 220 formed therein. The aperture 220 may resemble, for example, a circular hole which may extend partly into the body 210 or completely through the body 210. In example embodiments the aperture 220, for example, may form a cylindrical passage which may be threaded to receive threads of a fastener 400 which may resemble a conventional screw.

In example embodiments, the connector 200 may have a T-shape and may be considered, by some artisans, a T-shaped nut. The body 210 of the connector 200 may have a width Wb which may be about the same size as, or slightly smaller than, the width W2 of the channel 105 of the rail 100. For example, the body 210 may have a width Wb of about one third of an inch when a width W2 of the channel 105 is about three eighths of an inch. The width Wf of the connector 200 associated with flanges 215 may be about the same as, or slightly smaller than, the width W3 of the channel 105. For example, the width Wf of the flanged portion of the connector 200 may be about three quarters of an inch or smaller when the width W3 of the channel 105 is about three quarters of an inch.

Figure 5A:
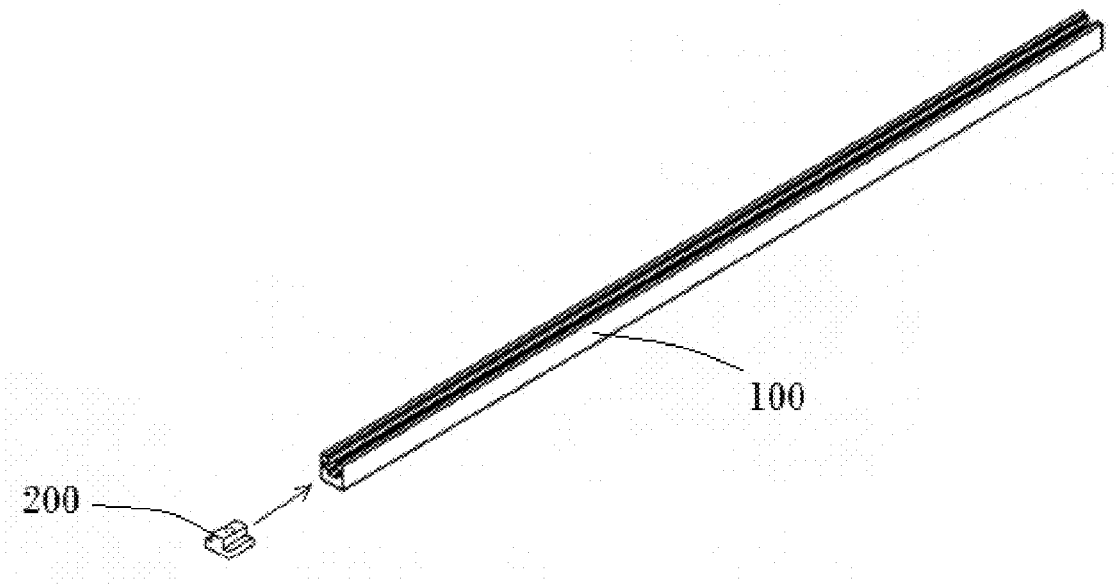
FIGS. 5A and 5B are views of the connector being inserted into the slide rail in accordance with example embodiments.
Figure 5B:
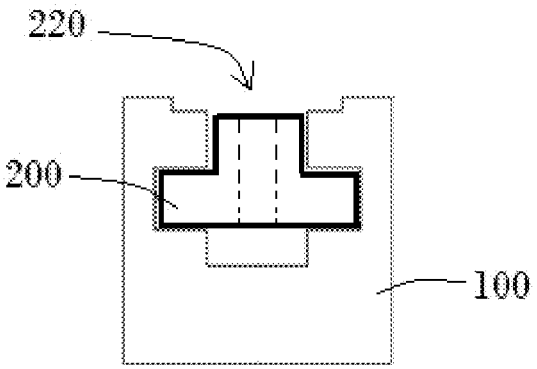

In example embodiments, a distance C1 from a top of the connector 200 to a top surface of the flange 215 may be about the same size as, or smaller than, the difference in depths D1 and D2 of the channel 105. In addition, a distance C2 from a top surface of the flange 215 to a bottom surface of the flange 215 may be about the same, or smaller than, a distance separating D2 and D3 of the channel 105. Given these relationships it is clear that connector 200 is insertable into the channel 105 of the rail 100. FIGS. 5A and 5B for example, illustrate the connector 200 being inserted into the channel 105 of the rail 100 with FIG. 5B being a view of the connector 200 inside the channel 105.

Figure 6A:
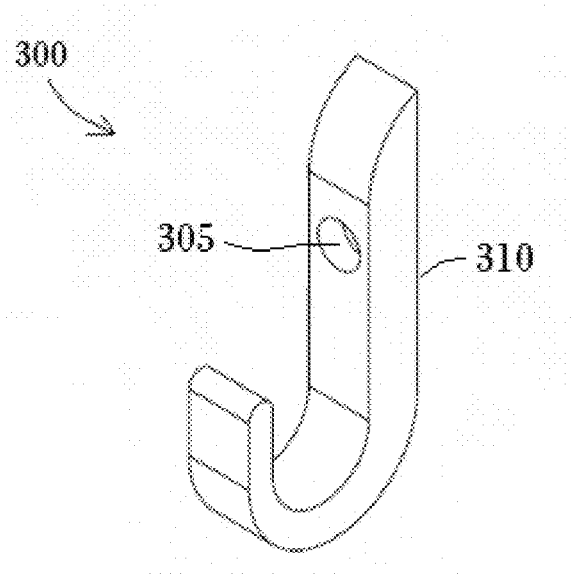
FIGS. 6A-6C are views of holder in accordance with example embodiments.
Figure 6B:
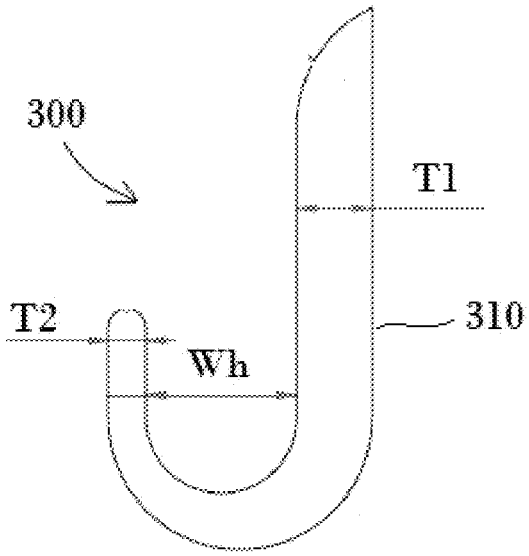
Figure 6C:
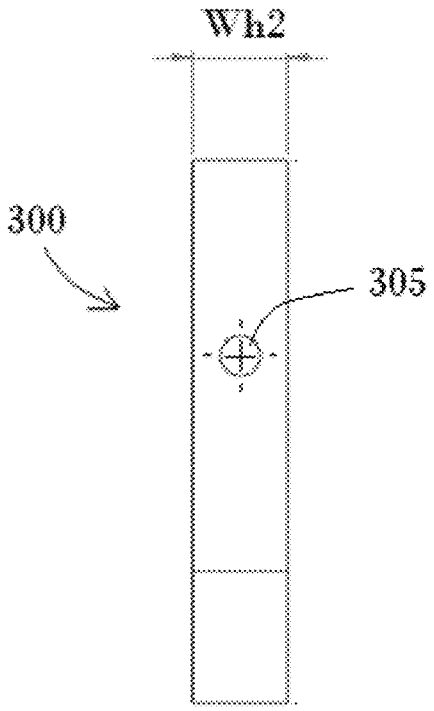

FIGS. 6A-6C illustrate various view of a holder 300 in accordance with example embodiments. In example embodiments, the holder 300 may resemble a J shaped member. In one embodiment the holder 300 may have a relatively constant thickness, however, this is not intended to limit the invention. For example, as shown in FIG. 6B, a thickness T1 of one portion of the holder 300 may be larger than a thickness T2 of another portion of the holder. In example embodiments the holder 300 may have a space with a width Wh sufficient to accommodate a butt or a barrel of a rifle. For example, in one embodiment, the width Wh may be about one inch, in another embodiment the width Wh may be about one and three quarters of an inch, in yet another embodiment the width Wh may be about two and a quarter inches. These dimensions, however, are only meant to illustrate various examples of the invention and are not intended to limit the invention.

In example embodiments, the holder 300 may include an aperture 305 which extends through a thickness of the holder 300. The aperture 305 may, for example, resemble a circular hole which may or may not be threaded and may be usable to allow the fastener 400 to connect the holder 300 to the connector 200. As will be explained shortly, the fastener 400 may be a threaded member, for example, a screw.

In example embodiments, the holder 300 may include a substantially flat portion 310 which may act as an interfacing surface which may interface with a portion of the channel 105. For example, the portion of the channel 105 having the width W1 may act as a receiving area of the channel 105 which may receive the interfacing portion of the holder 400. In example embodiments a width Wh2 of at least a portion of the holder 300 may be about the same size as, or slightly smaller than width W1 of the channel 105. This allows at least a portion of the holder 300 to be insertable into at least a portion of the channel 105. For example, in one embodiment, the width W1 of the channel 105 may be about 0.635 inches and the width Wh2 of the holder 300 may be about 0.625 inches.

Figure 7A:
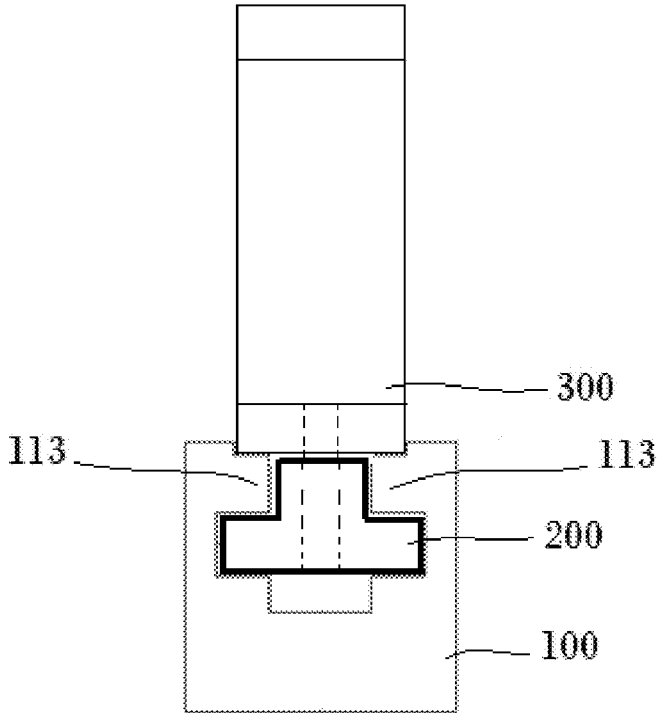
FIGS. 7A-7B are views showing the holder attached to the slide rail in accordance with example embodiments
Figure 7B:
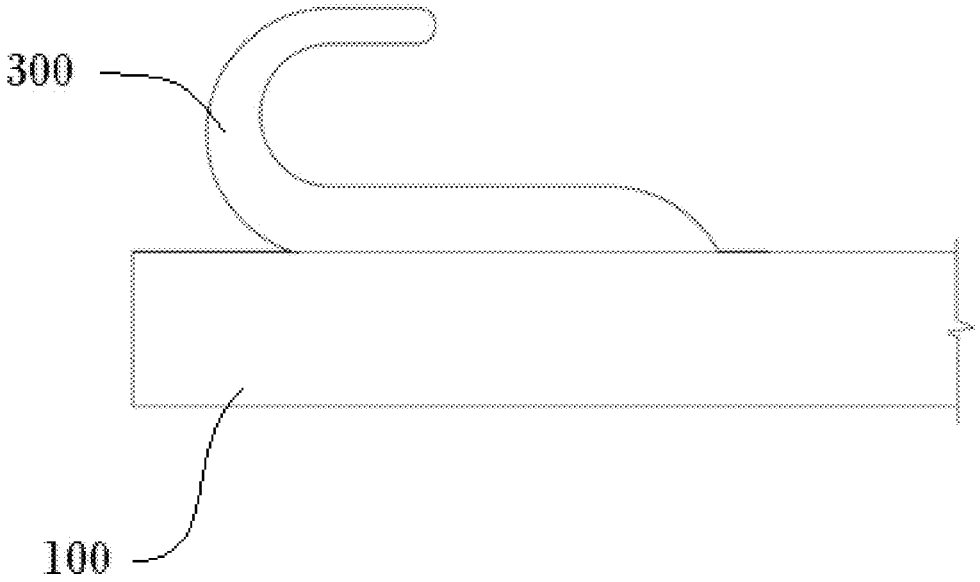
Figure 8A:
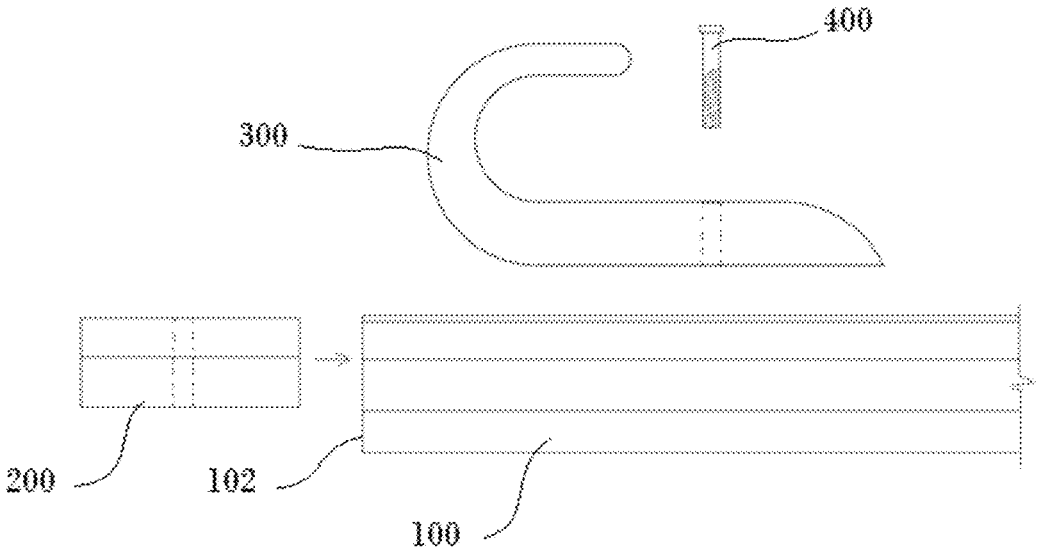
FIGS. 8A-8D are views showing the holder attached to the slide rail in accordance with example embodiments.
Figure 8B:
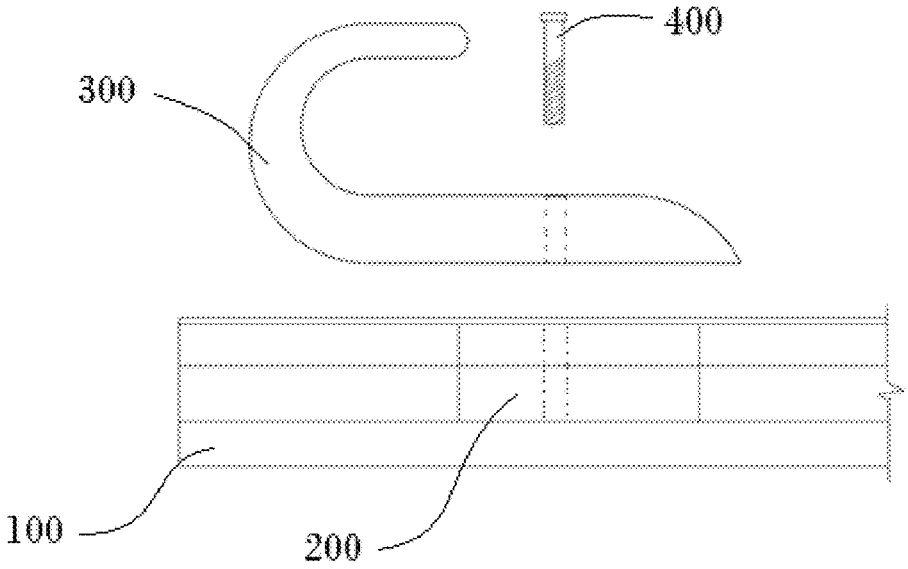
Figure 8C:
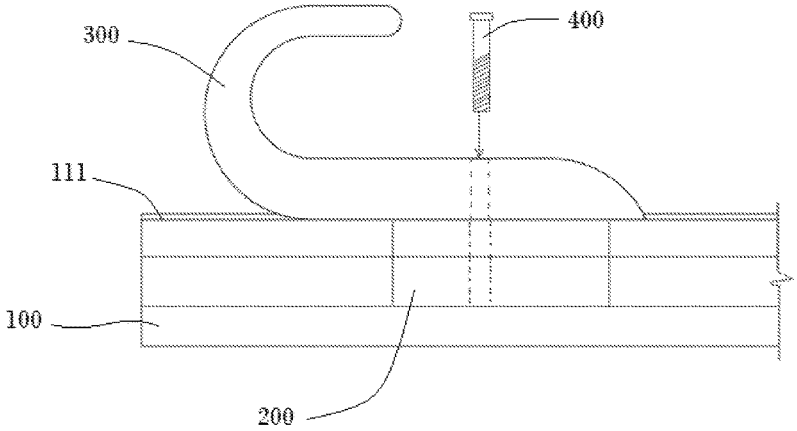
Figure 8D:
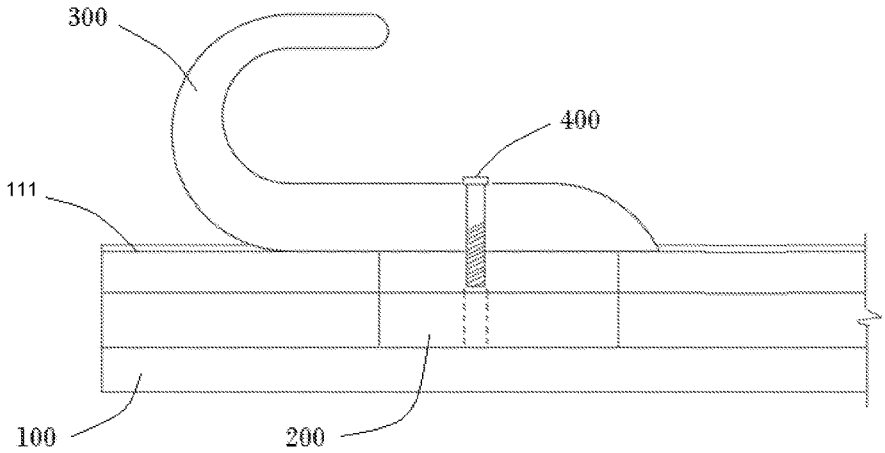
Figure 9A:
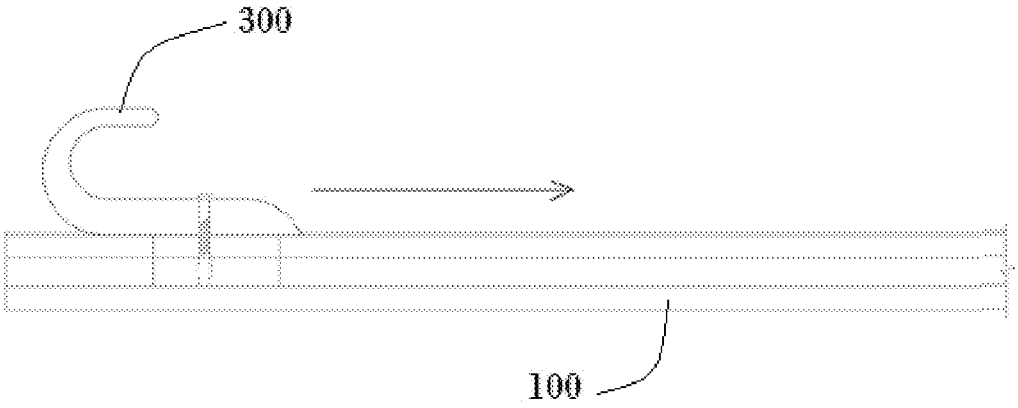
FIGS. 9A-9B illustrate a built in adjustability of the holder attached to the slide rail in accordance with example embodiments.
Figure 9B:
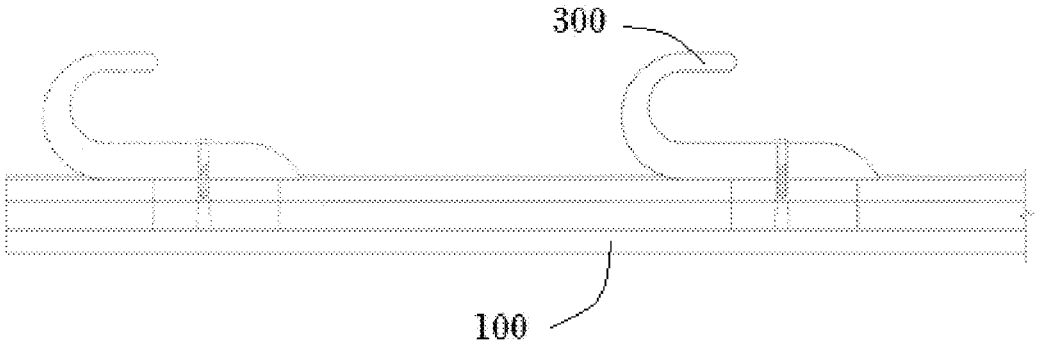

FIGS. 7A and 7B illustrate a portion of the rail 100 with the holder 300 attached thereto. FIGS. 8A-8C are provided to better illustrate how the example holder 300 may be secured to the example rail 100. As shown in FIG. 8A, the connector 200 may be arranged near the end 102 of the rail 100 and inserted into the channel 105 of the rail 100 as shown in FIG. 8B. When the connector 200 is inserted into the channel 105 of the rail 100, the aperture 220 may be exposed by the channel 105. The holder 300 may be inserted into the receiving area of the channel until the surface 310 contacts the surface 111 of the rail 100 as shown in FIG. 8C. The aperture 305 of the holder 300 may be aligned with the aperture 220 of the connector 200 as shown in FIG. 8C and a connector 400, for example, a screw, may be inserted through the aperture 305 of the holder 300 and into the aperture 220 of the connector 200 so that threads of the fastener 400 engage threads of the aperture 220. In the event the fastener 400 is a screw, the screw may be turned which may bias the connector 200 upwards towards the holder 300 thus clamping the holder 300 to the rail 100. In this nonlimiting example embodiment, the clamped portion may resemble a protrusion 113 extending into the channel 105. The holder 300, however, may be easily moved along the channel 105 by loosening the screw and then sliding the entire unit 200, 300, and 400 along the channel 105 as shown in FIGS. 9A-9B.

In example embodiments an outer portion of the channel 105 may be defined by the surfaces 111 and side walls 112. The side walls 112 may be separated by the distance W1 which may be about the same size as, or slightly larger than, the width Wh2 of a portion of the holder 300. As such, at least a portion of the holder 300 may reside in the channel 105. Given that example embodiments provide an embodiment in which the side walls 112 may have a spacing W1 nearly identical to (or slightly larger than) a width Wh2 of at least a portion of the holder 300, example embodiments provide an embodiment in which the side walls 112 may prevent the holder 300 from rotating within in the channel 105. Thus, example embodiments provide an example of holder 300 and a rail 100 wherein the holder 300 and the rail 100 are configured to allow the holder 300 to translate along a length of a rail 100 while being restrained from rotating by the side surfaces 112.

Figure 10:
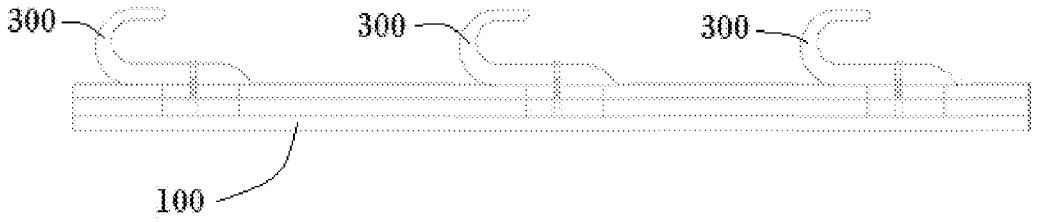
FIG. 10 illustrates three holders attached to a slide rail in accordance with example embodiments.

FIG. 10 illustrates three holders 300 attached to rail 100. Each of the holders 300 may easily be moved along a length of the rail 100 as explained above and fixed in place. Also, each holder 300 is also removable by simply unscrewing the connector 400 used to attach the holder 300 to the connector 200. Thus, one or more of the holders 300 may be removed to implement a gun rack having less than three holders 300. Of course, it is understood additional holders may be easily added to the rail 100, thus, a gun rack may have more than the three holders 300 illustrated in FIG. 10.

Figure 11:
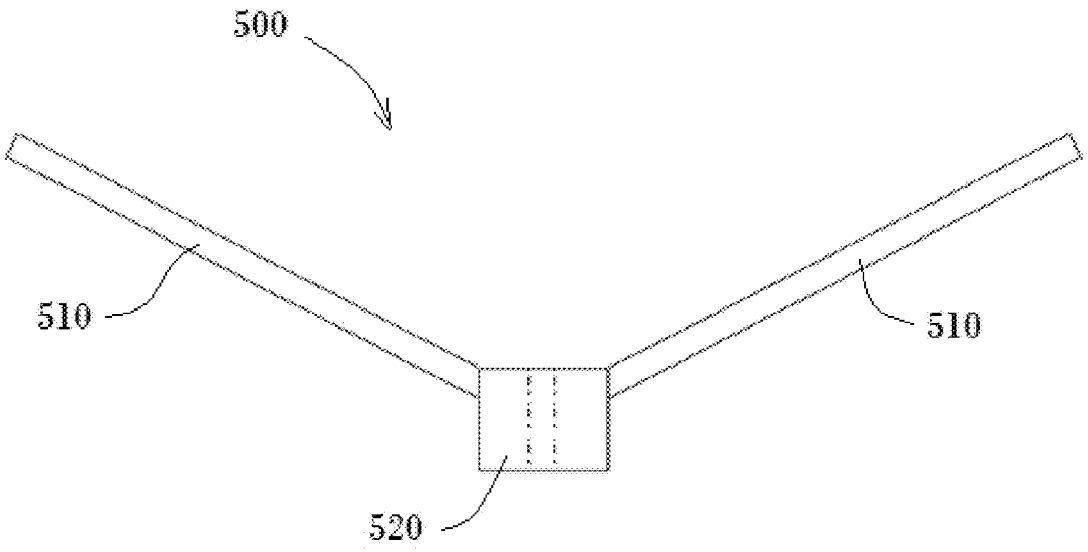
FIG. 11 illustrates another example of a holder in accordance with example embodiments.

Example embodiments are not intended to be limited by the preceding examples. For example, FIG. 11 illustrates another type of holder 500. In example embodiments, holder 500 may include a block shaped body 520 with fingers 510 extending therefrom. The fingers 510 may resemble rod like members and may be configured to fit inside the barrels of a pistol. As such, the holder 500 may be used to support a hand gun by the hand gun's barrel.

Figure 12A:
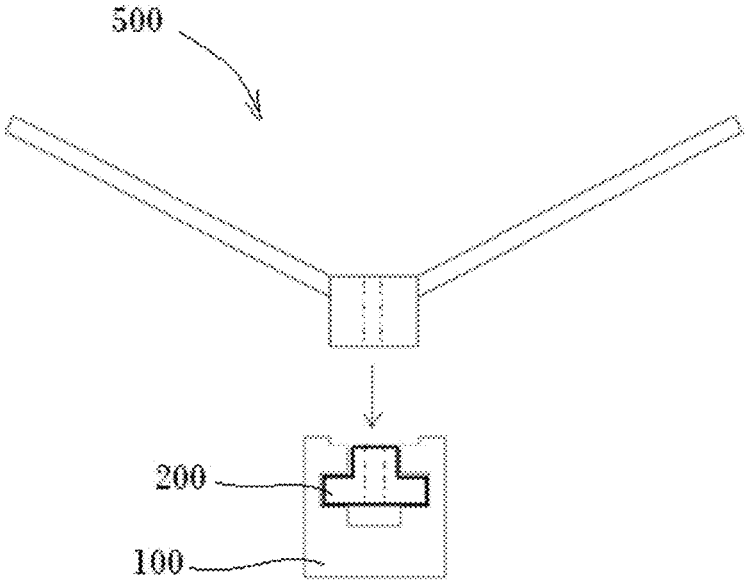
FIGS. 12A-12C illustrate the alternative holder attaching to the slide rail in accordance with example embodiments.
Figure 12B:
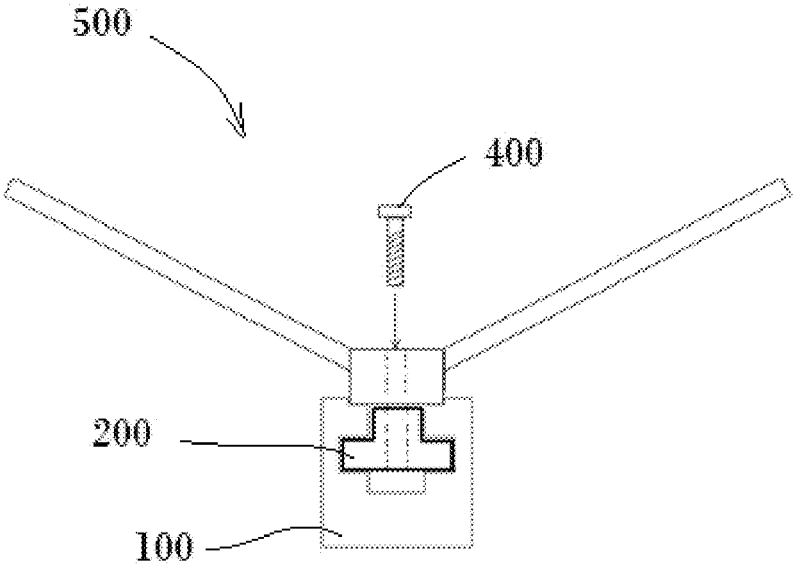
Figure 12C:
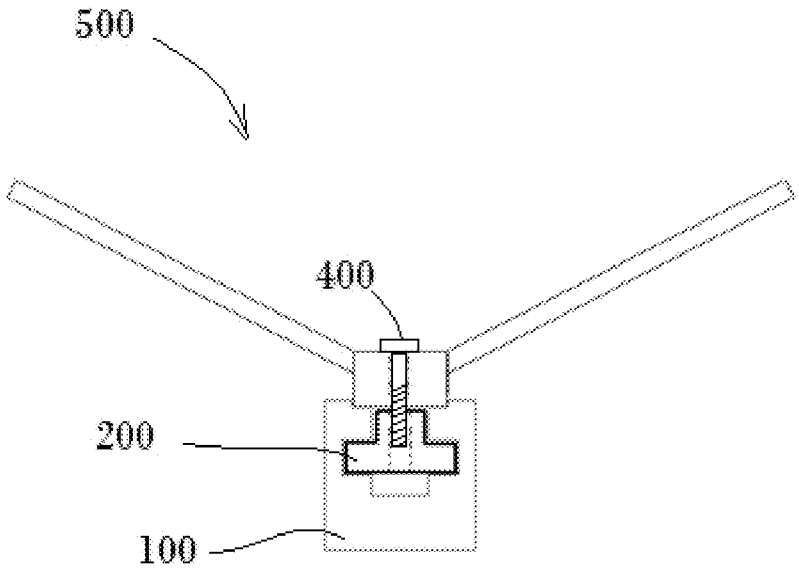
Figure 13A:
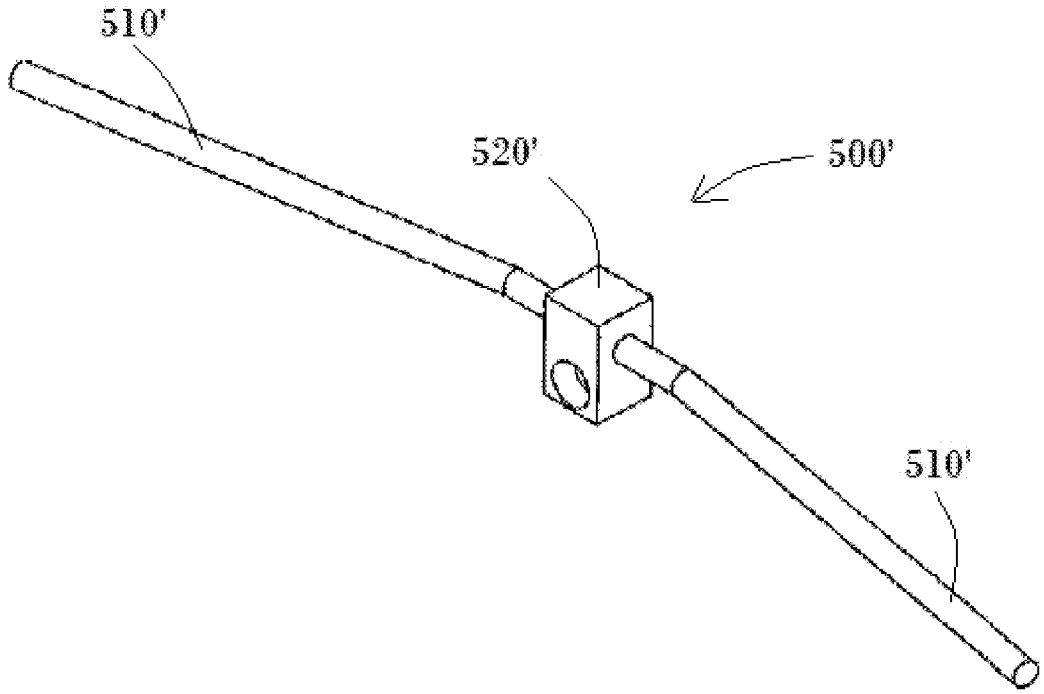
FIGS. 13A-13D illustrate an alternative holder in accordance with example embodiments.
Figure 13B:
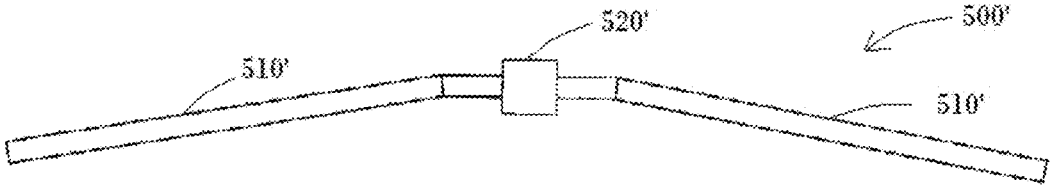
Figure 13C:
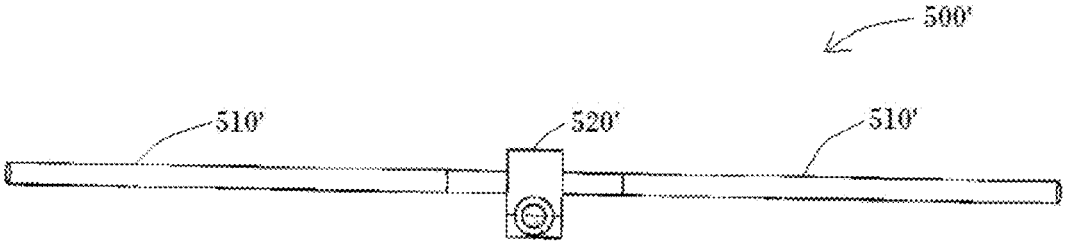
Figure 13D:
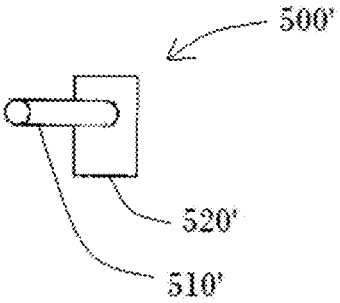

FIGS. 12A-12C illustrate how the holder 500 may be attached to the rail 100. As shown in FIGS. 12A-12C the block shaped body 520 may be inserted into the receiving area of the channel 105 and secured thereto via fastener 400 consistent with the above example.

Figure 14:
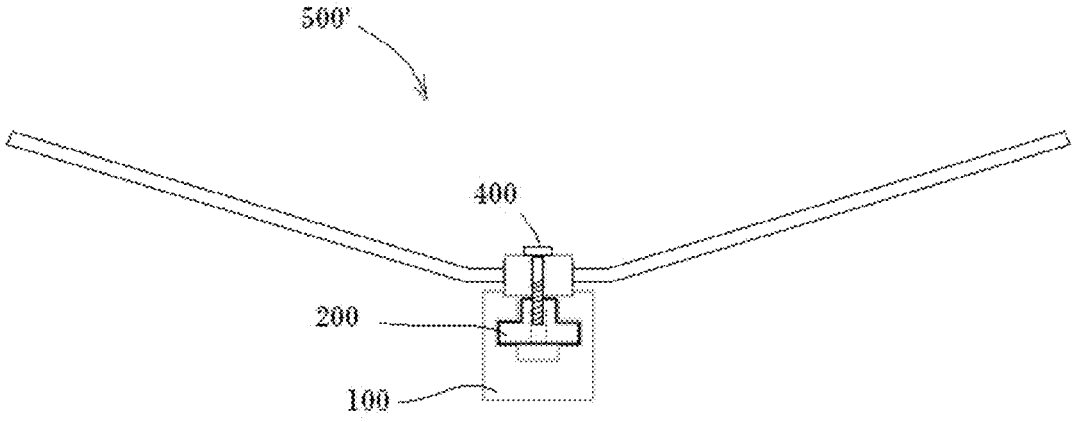
FIG. 14 illustrates the alternative holder secured to a rail in accordance with example embodiments.

FIGS. 13A-13D illustrate another example of a holder 500'. In example embodiments, the holder 500' is similar to the holder 500 in that it may include a block shaped body 520' with fingers 510' extending therefrom. The fingers 510' may resemble rod shaped members and may be configured to fit inside the barrels of a pistol. As such, the holder 500' may be used to support a hand gun by the hand gun's barrel. FIG. 14 illustrates the holder 500' attached to the rail 100 by a fastener 400 and a connector 200.

It is to be appreciated that the bodies 520 and 520' of holders 500 and 500' have a width sufficient to fit inside the first region of the channel 105 and may be sized so the sidewalls of the first regions, while allowing the bodies 520 and 520' to traverse along a length of the channel 105, prevent the bodies 520 and 520' from rotating.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What is claimed is:

1. A rack comprising:

a rail having a stepped channel formed in the rail, the stepped channel having a first region with a first width, a second region with a second width, and a third region with a third width, the first and third widths being greater than the second width and the second region being between the first region and the third region, wherein the rail includes a pair of protrusions each extending into the channel;

a connector having a body with at least one flange, the body being insertable into the second region and the at least one flange being insertable into the third region, the connector further including a threaded aperture;

a holder having a flat portion configured to insert and nest within the first region, the holder further including an aperture, wherein the holder and connector are configured to be detachably coupled together; and a threaded fastening member configured to pass through the aperture in the holder and be inserted within the threaded aperture of the connector so that when the threaded fastening member is rotated it draws the at least one flange against rear surfaces of the pair of protrusions so the pair of protrusions are clamped between the holder and the at least one flange with a force to prevent the holder and the connector from moving along the channel, wherein sidewalls of the first region prevent the holder from rotating while the threaded fastening member is rotated.

2. The rack of claim 1, wherein a width of a portion of the holder is about the same as the first width and the first region is defined by a pair of walls which prevent the holder from rotating when the holder is inserted into the first region.

3. The rack of claim 2, wherein a depth of the body is smaller than a depth of the second region.

4. The rack of claim 3, wherein the holder has a substantially J-shaped.

5. The rack of claim 4, wherein a thickness of the holder varies along a length of the holder.

6. The rack of claim 5, wherein the holder is configured to hold at least one of a barrel and a butt of a rifle.

7. The rack of claim 3, wherein the holder includes at least one finger configured to insert into a barrel of a gun.

8. The rack of claim 1, wherein the at least one flange is a pair of flanges.

9. The rack of claim 1, wherein the stepped channel is symmetric.

10. The rack of claim 1, wherein the holder directly contacts front surfaces of the pair of protrusion and the at least one flange directly contacts a the rear surfaces of the pair of protrusion.

11. A rack comprised of:

a rail having a channel formed in the rail, the rail including a pair of protrusions protruding into the channel to form a first region above the pair of protrusions, a second region between the pair of protrusions, and a third region below the pair of protrusions, the first region having a first width, the second region having a second width, and the third region having a third width, the first and third widths being greater than the second width;

a T-shaped connector having a body with a flange, the body being insertable into the second region and the flange being insertable into the third region and configured to contact bottom surfaces of the pair of protrusions, the connector further including a threaded aperture;

a holder having a flat portion configured to insert and nest within the first region and having a width about the same as the first width, the holder further including an aperture, wherein the holder and connector are configured to be detachably coupled together; and a threaded fastening member configured to pass through the aperture in the holder and be inserted within the threaded aperture of the connector so that when the threaded fastening member is rotated it draws the flange against rear surfaces of the pair of protrusions so the pair of protrusions are clamped between the holder and the flange with a force to prevent the holder and T-shaped connector from moving along the channel, wherein sidewalls of the first region prevent the holder from rotating while the threaded fastening member is rotated.

* * * * *